US010588361B2

(12) United States Patent
Ketterhagen

(10) Patent No.: US 10,588,361 B2
(45) Date of Patent: Mar. 17, 2020

(54) PROTECTIVE GARMENTS WITH ADJUSTABLE CLOSURE SYSTEMS

(71) Applicant: Crystal Ketterhagen, Sun Prairie, WI (US)

(72) Inventor: Crystal Ketterhagen, Sun Prairie, WI (US)

(73) Assignee: Crystal Ketterhagen, Sun Prairie, WI (US)

( * ) Notice: Subject to any disclaimer, the term of this patent is extended or adjusted under 35 U.S.C. 154(b) by 268 days.

(21) Appl. No.: 15/627,734

(22) Filed: Jun. 20, 2017

(65) Prior Publication Data

US 2017/0360123 A1 Dec. 21, 2017

Related U.S. Application Data

(60) Provisional application No. 62/352,059, filed on Jun. 20, 2016.

(51) Int. Cl.
*A41D 13/04* (2006.01)

(52) U.S. Cl.
CPC ..... *A41D 13/04* (2013.01); *A41D 2300/324* (2013.01); *A41D 2300/326* (2013.01)

(58) Field of Classification Search
CPC ..... A41D 13/0007; A62B 35/0018
USPC ..... 2/92, 94, 459, 462, 463
See application file for complete search history.

(56) References Cited

U.S. PATENT DOCUMENTS

| | | | | |
|---|---|---|---|---|
| 6,021,528 | A * | 2/2000 | Jurga | A63B 71/12 2/326 |
| 6,233,740 | B1 * | 5/2001 | Meyers | A41D 13/0007 2/102 |
| 6,367,582 | B1 * | 4/2002 | Derby | A62B 35/0018 119/857 |
| 2007/0256890 | A1 * | 11/2007 | Petzl | A62B 35/0018 182/3 |
| 2007/0278036 | A1 * | 12/2007 | Barta | A62B 35/0018 182/3 |
| 2008/0120768 | A1 * | 5/2008 | Tsujimoto | A63B 71/12 2/463 |
| 2012/0050036 | A1 * | 3/2012 | Landry | A62B 35/0018 340/540 |
| 2016/0220855 | A1 * | 8/2016 | Wood | A62B 35/0018 |
| 2016/0332009 | A1 * | 11/2016 | Chevalier | A62B 35/0012 |
| 2016/0375279 | A1 * | 12/2016 | McKay | A62B 35/0075 182/3 |
| 2017/0216635 | A1 * | 8/2017 | Stibilj | A62B 35/0018 |
| 2017/0291047 | A1 * | 10/2017 | Bouquier | A62B 35/0018 |
| 2018/0161607 | A1 * | 6/2018 | Jacob | A62B 35/0025 |

* cited by examiner

*Primary Examiner* — Gloria M Hale
(74) *Attorney, Agent, or Firm* — Quarles & Brady LLP

(57) ABSTRACT

Disclosed herein are adjustable closure system comprises a first flap configured to extend inwardly from a first side of a wearer, a second flap configured to extend inwardly from a second side of the wearer, and an adjustable suspension strap. The first flap may comprise a plurality of first fasteners. The second flap may comprise a plurality of second fasteners. The adjustable suspension strap may comprise a third fastener. The adjustable suspension strap is configured to be secured to the first flap, the second flap, or both the first flap and the second flap. Also disclosed herein are protective garments such as aprons comprising the adjustable closure system.

20 Claims, 8 Drawing Sheets

PROTECTIVE GARMENTS WITH ADJUSTABLE CLOSURE SYSTEMS

CROSS REFERENCE TO RELATED APPLICATIONS

This application claims benefit of priority to U.S. Provisional Application No. 62/352,059, filed on 20 Jun. 2016, the contents of which are incorporated herein by reference in its entirety.

FIELD OF INVENTION

The present invention relates generally to protective garments. More particularly, the present invention relates to full or half protective garments with an adjustable closure system.

BACKGROUND

Protective garments, including aprons, have been well used for ages and will continue to be worn into the far future. Although the function of protective garments to protect the wearer and their clothes from incidental marks and stains has remained the same throughout the years, their use and social status has changed with each culture over time. Aprons of the past were largely worn by the working class, servants and the domestically inclined—often out of public site. As a result, protective garments often exhibit simplistic design and utility standards.

From the 1910s through the 1950s, aprons were as much a fashion statement as they were a functional accessory with each era is marked with apron designs that matched the trends of the time. Aprons reached their peak in popularity in the 1950s when they became the symbol of the professional housewife. The apron fell out of favor in the 1960s with the rise of feminism and women's desire to work outside the home. People then either chose not to wear an apron at all, or they often chose the bib apron because its boxy design countered the feminine designs of the 1950s. The bib apron has remained the main apron design offered by the apron market even though our style, taste and lifestyles have changed in the past 60 years.

A broad cross section of people wears protective garments in public settings today. Protective garments are no longer worn in subordination, but in celebration of our own ability to get the job done. For example, television hosts wear aprons on cooking shows, friends wear aprons to host dinner parties, foodies wear aprons to bake, and gardeners wear aprons to harvest. People that wear an apron wear it often; they wear an apron at work, home, studio and stage and may even have an apron that is outfitted specifically for each job at hand. People wear an apron like a functional accessory.

Although our societal preferences have evolved and the jobs we wear an apron for are altogether different than the reasons we wore aprons in past eras, the apron design and utility systems have been updated very little since aprons earliest recordings. Even today the apron design block that dominates the current apron market is a version the waist apron (which covers the front body from the waist down) and the bib apron (which covers the upper and lower front body). These unisex, one-size-fits-all aprons consists of a single fabric panel and trim with suspension and closure systems that work with this design block. This single-panel apron model is made possible thanks to the utility of the tie closure which is often combined with an adjustable neck loop, Y-back, or cross-back suspension that secures the top front apron to the wearer. The waist and bib aprons are tied to fit the wearer—not designed to fit—and thus has all the disadvantages that come with simplistic design and utility solutions.

The tie-back closure system adds bulk to the waistline and creates an unpredictable and unfinished silhouette. In addition, it does not have the apron area or durability needed on the backside of the apron for utilitarian features like pockets, loops and snaps.

Suspending aprons with a neck loop leads to additional problems. The neckline often pops off the chest at the center front for poor draping. Also, the neck loop rests the weight of the apron on the wearer's neck and can contribute to neck pain and headaches with extended and/or frequent use.

Cross-back closure systems are cumbersome to put on and take off. When cross-back aprons are put on, taken off, stored or hung the trim can easily slip out of their grommets or loops. Moreover, the cross-back apron does not have the apron area or durability needed on the backside of the apron for utilitarian features like pockets, loops and snaps.

Y-back suspension systems loop over the wearer's neck and around the waist, resulting in a utility system that looks unresolved. Some newer aprons have a hook or buckle closure system that reduces the bulk at the waist line but do not allow for the apron area or durability on the backside of the apron for utilitarian features like pockets, loops and snaps. In addition, the buckle or hook hardware components are heavy and add weight to the apron.

In sum, the aprons invented thus far are locked into the one-size-fits-all, uni-sex, tie-closure or single-panel apron design block that makes the waist and bib aprons. The market standard in every other area of the consumer's modern life has evolved to a high taste level with refined standards and high- to low-brow subgenres. But this is not the case for the apron market which continues to produce single-panel designs and outdated utility systems. Even the most innovative apron utility inventions will fall short when working within the single-panel apron design block because the consumer and business apron market is vastly different than it was when the apron design and utility system was created.

Today's apron market needs a completely new apron design and utility system that together create a stylish apron that is as well-sculpted as it is functional. Today's consumers need an apron that not only protects their clothing from incidental marks, but they also need an apron that adds a top layer of style to the wearer's overall look like a functional accessory. This new apron needs to be highly wearable, flattering, functional and stylish. This new apron needs to flatter one's figure—male or female—and have predictable drape and a finished silhouette. This new apron needs to be available in sizes so as to achieve a tailored-like fit that is comfortable and flattering. This new apron needs a design and utility system that is engineered at the same time so as to create a completely new apron that addresses both the functional and aesthetic needs of today's modern doers.

SUMMARY OF THE INVENTION

Disclosed herein are protective garments having an adjustable closure system. The adjustable closure system allows for garments that flatter both male and female figures, have a predictable drape, a finished silhouette, and a tailored fit for a variety of sizes. The adjustable closure system comprises a first flap configured to extend inwardly from a first side of a wearer, a second flap configured to extend inwardly from a second side of the wearer, and an adjustable suspension strap. The first flap may comprise a plurality of first fasteners. The second flap may comprise a plurality of second fasteners. The adjustable suspension strap may comprise a third fastener. The adjustable suspension strap is configured to be secured to the first flap, the second flap, or both the first flap and the second flap. The adjustable suspension strap comprises a first strap portion, wherein the first strap portion configured to extend downwardly from one or both shoulders of the wearer of the garment and wherein the first strap portion distal to the one or both shoulders of the wearer of the protective garment is doubled over itself and adjustably secured to itself; a second strap portion, the second strap portion comprising the third fastener; and a connector joining the first strap portion and the second strap portion.

Another aspect of the invention is a bib for use with the protective garment having a seamless dart to provide shape to garment. The bib comprises a shoulder edge, a bottom edge, and an outside edge, wherein the shoulder edge comprises a curved portion extending inwardly from the outside edge and/or the bottom edge comprises a curved portion extending inwardly from the outside edge.

Another aspect of the invention is a protective garment, the protective garment comprising any the adjustable closure systems disclosed herein and/or a seamless dart. The protective garments may be a full apron, top-half apron, or a bottom-half apron. The protective garments may further comprise elements to tailor the garment for particular uses, e.g., pockets and/or loops. Moreover, the protective garments may be made from a variety of materials, including denim or leather.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention.

FIG. 3A depicts a front-view of the protective garment. FIG. 3B depicts a back-view of the protective garment. FIG. 3C depicts a side-view of the protective garment.

FIG. 4A depicts a front-view of the protective garment. FIG. 4B depicts a back-view of the protective garment. FIG. 4C depicts a side-view of the protective garment.

FIG. 5A depicts a front-view of the protective garment. FIG. 5B depicts a back-view of the protective garment.

FIG. 6A depicts a front-view of the protective garment. FIG. 6B depicts a back-view of the protective garment.

FIG. 7A depicts a front-view of the protective garment. FIG. 7B depicts a back-view of the protective garment.

DETAILED DESCRIPTION

Disclosed herein are protective garments having an adjustable closure system. The adjustable closure system allows for the protective garments to be highly wearable, flattering, functional and stylish. The adjustable closure system also allows for the protective garment to flatter both male and female figures, have a predictable drape, a finished silhouette, and a tailored fit for a variety of sizes. The adjustable closure system secures the garment to the wearer without a bulky tie closure and creates a predictable drape and a sleek silhouette. The adjustable closure system is easy and quick to secure and unsecure. Moreover, the adjustable closure system is transferable to any type of garment, including protective garments, whether tailored to men or women.

Figure 1A:
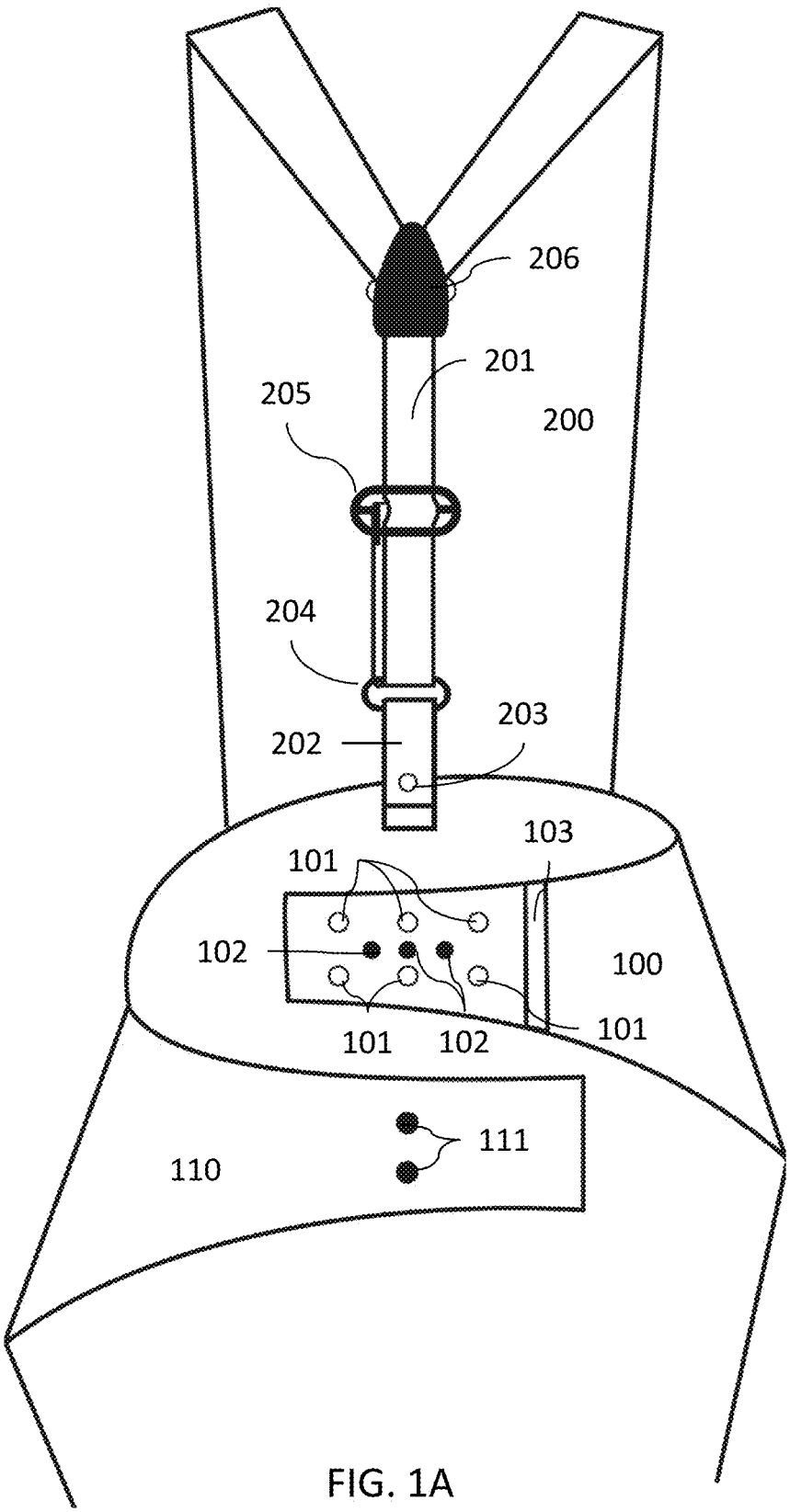
FIG. 1A illustrates an exemplary protective garment having an adjustable closure system
Figure 1B:
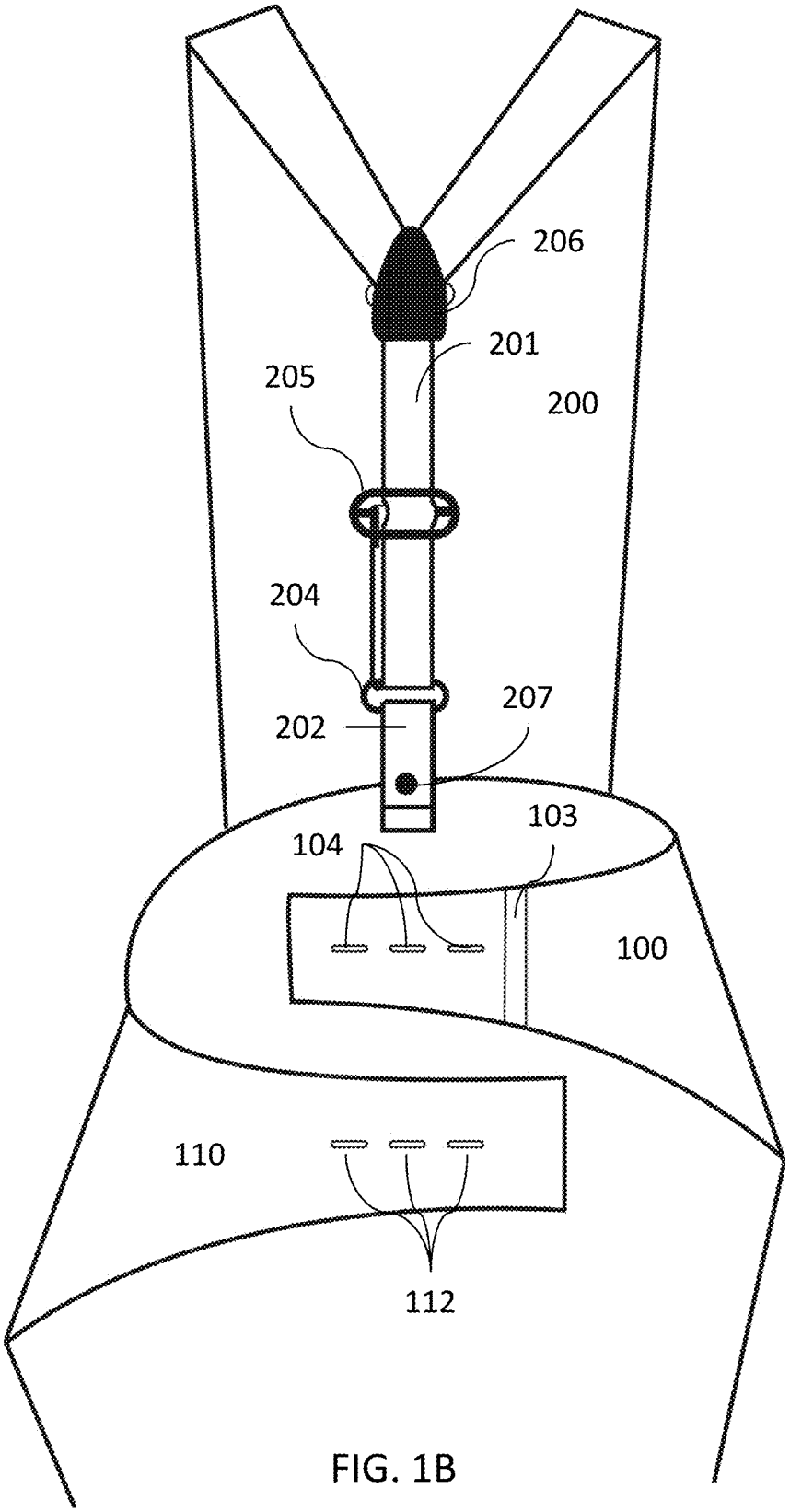
FIG. 1B illustrates an exemplary protective garment having an adjustable closure system.

Exemplary adjustable closure systems are provided in FIGS. 1A and 1B. The adjustable closure system for use with a garment, including protective garments, comprises a first flap 100 configured to extend inwardly from the torso, waist, and/or hips of a wearer of the garment across the midline of the back from a first side of the wearer of the garment and a second flap 110 configured to extend inwardly from the torso, waist, and/or hips of the wearer of the garment across the midline of the back from a second side of the wearer of the garment, wherein the first side and the second side are different sides of the wearer of the garment. In some embodiments, first flap may extend inwardly from the right side of the torso, waist, and/or hips of the wearer of the garment traverse the midline of the wearer and the second flap may extend inwardly from the left side of the torso, waist, and/or hips of the wearer of the garment traverse the midline of the wearer. In other embodiments, first flap may extend inwardly from the left side of the torso, waist, and/or hips of the wearer of the garment traverse the midline of the wearer and the second flap may extend inwardly from the right side of the torso, waist, and/or hips of the wearer of the garment traverse the midline of the wearer.

The first flap and the second flap are designed to overlap with and be secured to each other or to an adjustable suspension strap. When the first flap and the second flap are overlapped and secured to each other, this allows for the garment to be secured to the wearer either by the first and second flaps alone or by the first and second flaps in combination with an adjustable suspension strap. Moreover, when the first flap and the second flap are overlapped and secured, some or all of the fasteners in the adjustable closure system may be concealed to provide a clean and considered silhouette. Further, when the flaps are overlapped and secured, the flaps may provide at least a portion of the apron area and/or strength to support pockets, towel loops, and or other functional elements that may tailored to particular uses for the garment. In some embodiments, the first flap is configured to lie between the back of the wearer of the garment and the second flap when the first flap and the second flap are secured to each other. In other embodiments, the second flap is configured to lie between the back of the wearer of the garment and the first flap when the first flap and the second flap are secured to each other.

In the exemplary embodiment shown in FIG. 1A, the first flap may comprise a first fastener 101 and the second flap may comprise a second fastener 111, wherein the first fastener 101 and the second fastener 111 are configured to be secured to each other. In some embodiments, the first fastener 101 is a plurality of first fasteners. Garments having a plurality of first fasteners allows for the wearer to select the amount of overlap between the first flap and the second flap to adjust to the hips, waist, or torso of a wearer over several inches to provide a tailored-like fit to the wearer of the garment by allowing the wearer to select one or more particular first fasteners the second fastener is secured to. The first and second fasteners allow for the garment to be snug against the wearer to prevent a bulky silhouette.

In some embodiments, the second fastener 111 is a plurality of second fasteners. In certain embodiments, the first fastener 101 is a plurality of first fasteners and the second fastener 111 is a plurality of second fasteners.

The plurality of first fasteners may be arranged in any manner on the first flap as to allow for the garment to be worn. In certain embodiments, the first fasteners may be arranged to allow for the garment to adjust 3 to 8 inches, or any amount there between, to accommodate wearers of all shapes and sizes while also providing for a tailored appearance. In certain embodiments, the plurality of first fasteners is arranged in one or more substantially linear rows. In particular embodiments, the plurality of first fasteners comprises 3, 4, 5, 6, 7, 8, 9, or 10 first fasteners. An odd number of fasteners in a row are preferred so that a central fastener can lie on or near the midline of the back of the wearer.

In some embodiments, the plurality of first fasteners is arranged in two or more substantially linear rows. In certain embodiments, the plurality of first fasteners is arranged in two or more substantially linear rows that traverse the midline of the back of the wearer. In certain embodiments, the plurality of first fasteners are arranged in two or more substantially linear rows and the plurality of first fasteners comprises 3, 4, 5, 6, 7, 8, 9, or 10 first fasteners. In particular embodiments, the plurality of first fasteners are arranged in two or more substantially linear rows and the plurality of first fasteners comprises 3, 4, 5, 6, 7, 8, 9, or 10 first fasteners and the plurality of second fasteners comprises a number of second fasteners configured to be secured to at least one first fastener on each of the two or more substantially linear rows of first fasteners. As shown in FIG. 1A, the plurality of first fasteners 101 are arranged in 2 substantially linear rows of 3 first fasteners, each, for a total of 6 first fasteners and 2 second fasteners 111 configured to be secured to at least one first fastener in each of the 2 rows.

The first fastener 101 and second fastener 111 may be any fastener suitable for use with a garment. The first fastener may be a male snap, a female snap, a button, a button hole, a hook, an eye, a buckle, or a tab. The second fastener may be a male snap, a female snap, a button, a button hole, a hook, an eye, a buckle, or a tab. Those of skill in the art may select the first fastener and the second fastener so that the first fastener and the second fastener may be secured to each other. By way of example only, a male snap and a female snap may be selected to be secured to each other, a button and a button hole may be selected to be secured to each other, a hook and an eye may be selected to be secured to each other, or a buckle and a tab may be selected to be secured to each other. In some embodiments, the first fastener 101 and the second fastener 111 are male snaps and female snaps.

The adjustable closure may further comprise one or more loops 103 configured to hold the overlapping and secured flaps substantially against each other. In some embodiments, the first flap further comprises one or more loops configured to hold the second flap substantially against the first flap.

The adjustable closure system may also comprise an adjustable suspension strap 200, wherein the adjustable suspension strap is configured to be secured to the first flap, the second flap, or both the first flap and the second flap. The adjustable suspension strap solves the problems with the neck loop, the one-size-fits-all, the cross back suspension systems, as well as the unresolved issues with the apron market's current Y-back suspension systems. Although the adjustable suspension strap may look similar to other Y-back utility solutions, the combination of the adjustable closure system and the adjustable suspension strap allows for a resolved, complete, refined and predictable fit to the wearer of the garment that, in turn, adds up to a sleek, smart, and styled utility solution.

When present, the adjustable suspension strap may comprise a first strap portion 201, wherein the first strap portion configured to extend downwardly from one or both shoulders of the wearer of the garment and wherein the first strap portion distal to the one or both shoulders of the wearer of the protective garment is doubled over itself and adjustably secured to itself; a second strap portion 202, wherein the second strap portion comprises a third fastener 203 configured to be secured to a fastener on the first flap, the second flap, or both the first flap and the second flap; and a connector 204 joining the first strap portion and the second strap portion.

As shown in FIG. 1A, the first flap 100 further comprises a fourth fastener 102. The fourth fastener 102 may comprise a plurality of fourth fasteners. Garments having a plurality of fourth fasteners allows for the wearer to select the horizontal and vertical alignment of the adjustable suspension strap to provide a tailored-like fit to the wearer of the garment by allowing the wearer to select one or more particular fourth fasteners the third fastener may be secured to. The adjustable suspension strap may adjust vertically with a range between 8"-11" allowing the garment to fit all body heights, e.g., petite, regular and tall. The adjustable apron strap interacts with the adjustable closure to adjust horizontally to achieve ideal alignment in response to the waist size selected.

In some embodiments, the plurality of fourth fasteners is arranged in one or more substantially linear rows. In certain embodiments, the plurality of fourth fasteners is arranged in one or more substantially linear rows that traverse the midline of the back of the wearer. An odd number of fasteners in a row are preferred so that a central fastener can lay on or near the midline of the back of the wearer. In particular embodiments, the plurality of third fasteners comprises 3 or 5 third fasteners. As shown in FIG. 1A, the plurality of fourth fasteners 102 are arrange in 1 substantially linear row of 3 fourth fasteners.

The third fastener 203 and fourth fastener 102 may be any fastener suitable for use with a garment. The third fastener may be a male snap, a female snap, a button, a button hole, a hook, an eye, a buckle, or a tab. The fourth fastener may be a male snap, a female snap, a button, a button hole, a hook, an eye, a buckle, or a tab. Those of skill in the art may select the third fastener and the fourth fastener so that the third fastener and the fourth fastener may be secured to each other. By way of example only, a male snap and a female snap may be selected to be secured to each other, a button and a button hole may be selected to be secured to each other, a hook and an eye may be selected to be secured to each other, or a buckle and a tab may be selected to be secured to each other. In certain embodiments, the third fastener 203 and fourth fastener 102 are male and female snaps.

The connector 204 may be any suitable piece of hardware or fabric suitable for connecting the first strap portion and the second strap portion. In some embodiments, the connector is loop, e.g. a rectangular ring, a D-ring, or an O-ring.

The first strap portion 201 may be secured to itself through any suitable fastener 205 that allows for the adjustment in the length of the adjustable suspension strap. In some embodiments, the first strap portion is adjustably secured to itself with a slide, buckle, reducer, strap adjuster, hook, loop, clasp, or fastener.

In some embodiments, the second strap portion 202, the connector 204, or both the second strap portion 202 and the connector 204 are configured to be fully or partially concealed by the first flap and/or the second flap.

The adjustable suspension strap may extend downwardly from one or both shoulders. The adjustable suspension strap may be substantially parallel with the midline of the wearer or traverse to the midline of the wearer. As shown in FIG. 1A, the adjustable suspension strap is configured to extend downwardly from both shoulders of the wearer and lay substantially parallel with the midline of the back of the wearer of the protective garment. In other embodiments, the first portion extends downwardly from one shoulder of the wearer and is transverse with the midline of the back of the wearer of the protective garment.

The adjustable suspension 200 strap may further comprise a hang loop. In certain embodiments, the adjustable suspension strap comprises a patch 206 and a hang loop connected to the patch. The hang loop may allow for the garment to hang in a balanced manner, which, in turn, minimizes warping or bending of the garment.

Another embodiment of the invention is illustrated in FIG. 1B. The embodiments exemplified in FIGS. 1A and 1B differ in that the first fastener 104 of the first loop 100 and the second fastener 112 on the second loop 110 shown in FIG. 1B are secured to third fastener 207 of the adjustable suspension strap 200 instead of to each other. This may be accomplished through a variety of ways, including through the use of a button on the adjustable suspension strap 200 and button holes on the first flap 100 and the second flap 110.

The adjustable closure system described may be used with any garment. In some embodiments, the garment is a protective garment configured to protect a wearer's clothing from incidental marks and/or stains. Protective garments include aprons of all types, including without limitation, full aprons that protect above and below the waist, top-half apron that protect primarily above the waist, or a bottom-half aprons that primarily protect below the waist.

In certain embodiments, a garment having an adjustable closure system comprises one or more pockets, towel loops, tool loops, or any combination thereof. In the Examples that follow, the use of pockets and loops are shown. In certain embodiments, the pocket comprises one or more compartments. In certain embodiments, the pocket comprises one, two, three, or more than three compartments. In embodiments having two, three, or more than three compartments, the pocket comprises dividers that divide the pocket into compartments. In particular embodiments, the dividers extend outwardly from the apron to provide give in the pockets and to allow for ease of entry of items into or removal of items from any of the compartments. A pocket may also comprise folds that further allow for the ease of entry into or removal or items from a compartment.

The protective garment may be made of any suitable fabric or material. Examples of fabrics or materials for use with the protective garment includes, without limitation, cotton, denim, wool, leather, or synthetic polymeric materials (e.g., rubber, vinyl, nylon, polyester), or any combination thereof.

The front of the protective garment covering the chest of the wearer may be designed for men and women of different sizes and proportions. Protective garments for adult women may have seamed darts or seamless darts, which may be also known as invisible darts, to provide shape to the garment accommodate the wearers bust with a tailored appearance and shape. Examples of seamless and seamed darts described in Examples 1 and 2. Protective garments may also have flat front as described in Examples 3 and 4.

It was surprisingly realized that seamless darts could be used provide shape for the protective garments having an adjustable closure systems as described herein. Seamless darts had not been used in this way before because there had not been a need. Garments usually cover the front and back portion of the torso so there has not been a need to get a front panel to curve with out a dart. Overalls have a front cover that is a simple flat panel and not designed to curve around the body. Bib aprons get the apron to lay snug to the body by employing a halter like method that wraps around the body and ties for the fit.

Seamless darts are created by trimming some of the ease from the bib pattern where it meets the shoulder strap and trim the rest of the ease from the bodice where it meets the skirt. Trimming this ease from the bib pattern forces the bodice to curve inward towards the body, thereby laying snug to the body giving a tailored and refined appearance. This method is preferred over a seamed dart because a dart moves up and down as the wearer adjusts closure system that, in turn, causes the seamed dart to fall below the breast apex on tall wearers and above the breast apex on short wearers.

Figure 2:
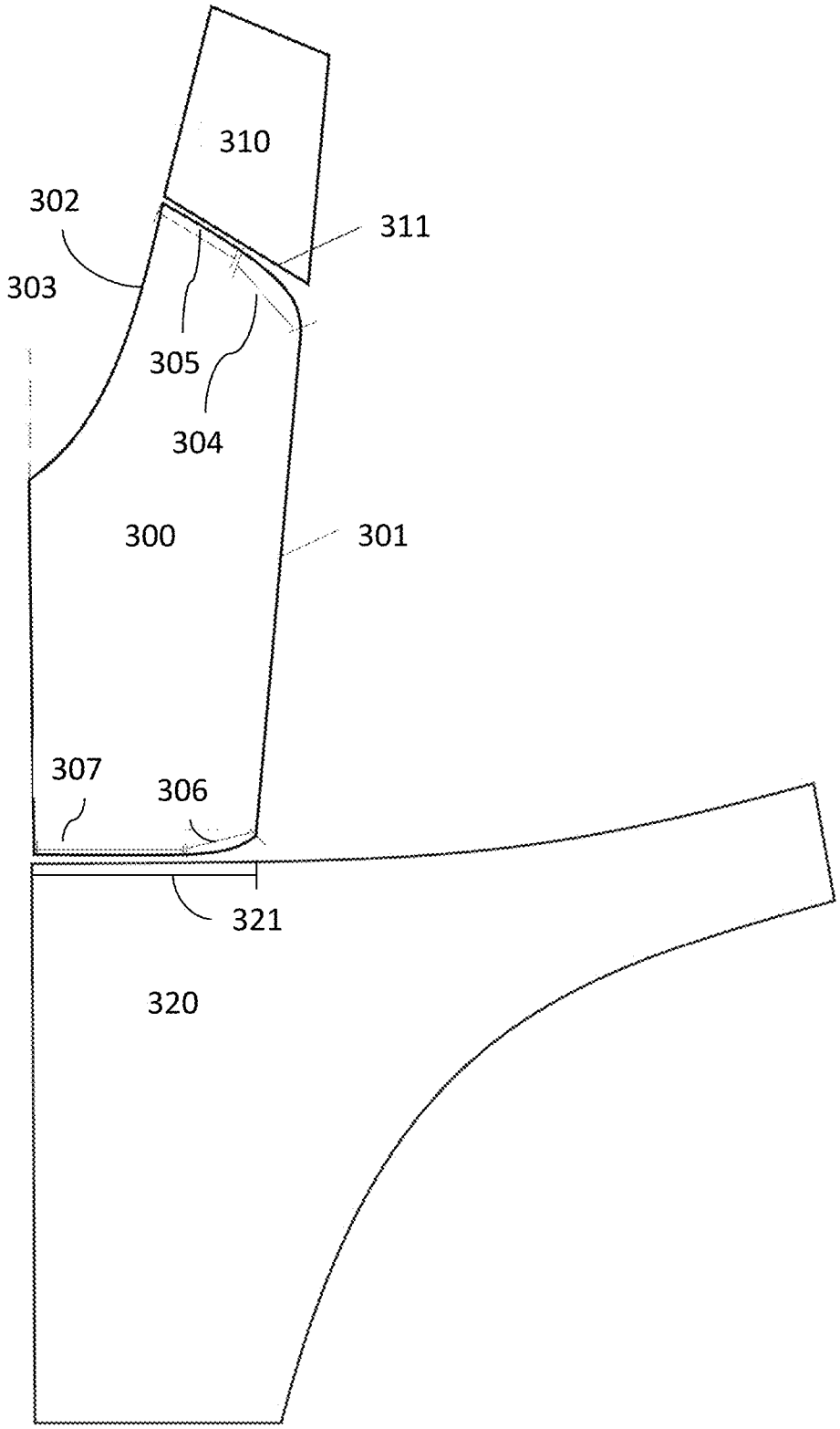
FIG. 2 illustrates an exploded view of a front portion of a protective garment having a seamless dart.

An exemplary pattern for preparing the seamless dart is illustrated in FIG. 2. The bib 300 of the protective garment comprises a shoulder edge. The shoulder edge comprises a curved portion 304 that extends inwardly from the outside edge 301. The curved portion may extend over a length of about 1 inch to about 3 inches or any length there between, including from about 1.5 inches to about 2.5 inches or about 2 inches. The ease may be trimmed from about ⅛ of an inch to about ½ of an inch or any amount there between, including from about ¼ of an inch to about ⅜ of an inch. The shoulder edge may further comprise a substantially linear portion 305 interposed between the curved portion 304 and an inner edge 302 that forms the neckline. The shoulder edge is configured to be joined to a shoulder strap 310 along a linear edge 311.

The bib 300 further comprises a bottom edge. The bottom edge comprises a curved portion 306 extending inwardly from the outside edge 301. The curved portion may extend over a length of about 1 inch to about 3 inches or any length there between, including from about 1.5 inches to about 2.5 inches or about 2 inches. The ease may be trimmed from about ⅛ of an inch to about ½ of an inch or any amount there between, including from about ¼ of an inch to about ⅜ of an inch. The bottom edge may further comprise a substantially linear portion 307 interposed between the curved portion 306 and the midline 303 of the bib 300. The bottom edge further extends to a second outside edge on the side opposite edge 301 of the wearer. The bottom edge may also comprise a curved portion that extends inwardly from the second edge and/or a substantially linear portion that interposed between the curved edge and the midline 303. The bottom edge is configured to be joined to a bottom front 320 along a substantially linear edge portion 321.

Tension created by joining the straight portions of the shoulder strap and/or the bottom front to the curved edge portions of the bib causes the strap to pull outward and for the outside edge to bend inward. When the protective garment is worn, the wearer's body pulls the outside edge into alignment and the outside edges hug inward to provide a fitted appearance.

Miscellaneous

All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred aspects of this invention are described herein, including the best mode known to the inventors for carrying out the invention. Variations of those preferred aspects may become apparent to those of ordinary skill in the art upon reading the foregoing description. The inventors expect a person having ordinary skill in the art to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

EXAMPLES

Example 1

Figure 3A:
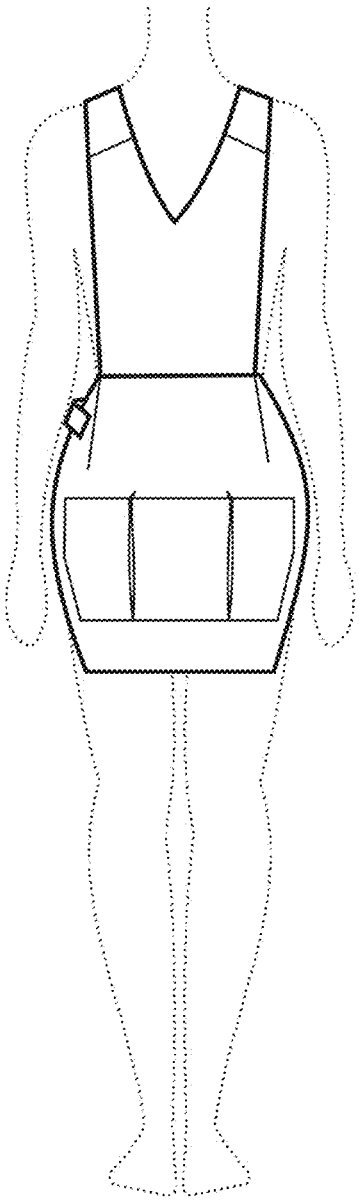
FIGS. 3A-3C illustrate an exemplary protective garment having a seamless dart.
Figure 3B:
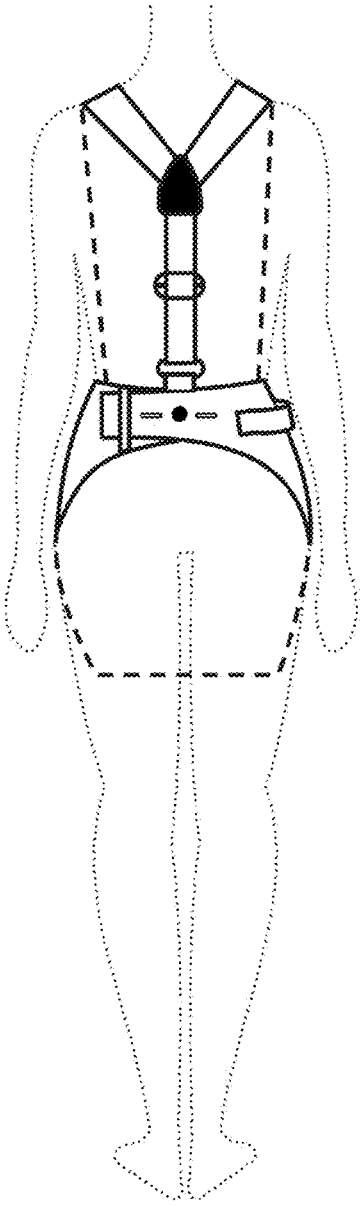
Figure 3C:
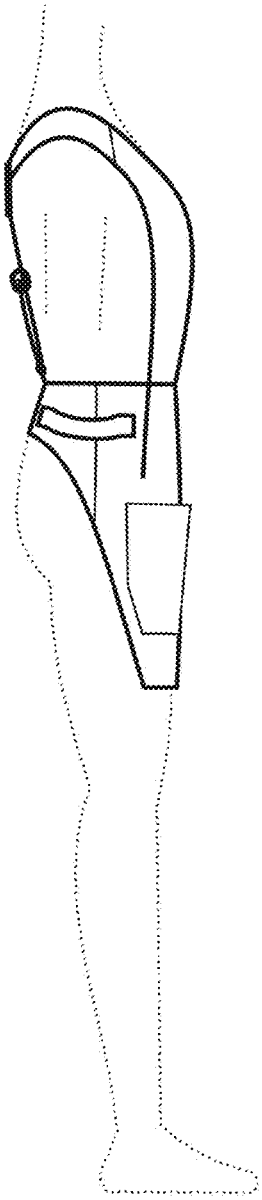

An exemplary protective garment having an adjustable closure system as substantially illustrated in FIG. 1B is provided in FIGS. 3A-3C. As shown, the protective garment comprises a bib with a seamless dart. Example 1 also demonstrates the incorporation of pockets and loops in the bottom portion of the garment.

Example 2

Figure 4A:
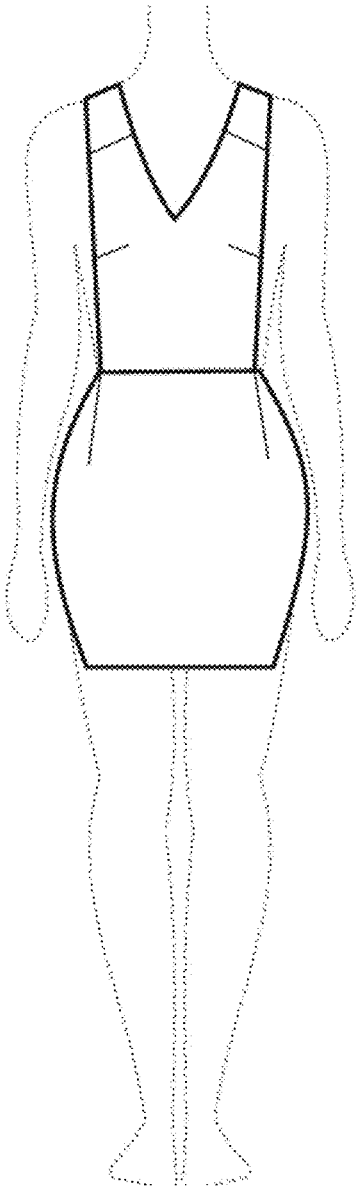
FIGS. 4A-4C illustrate an exemplary protective garment having a seamed dart on the bib.
Figure 4B:
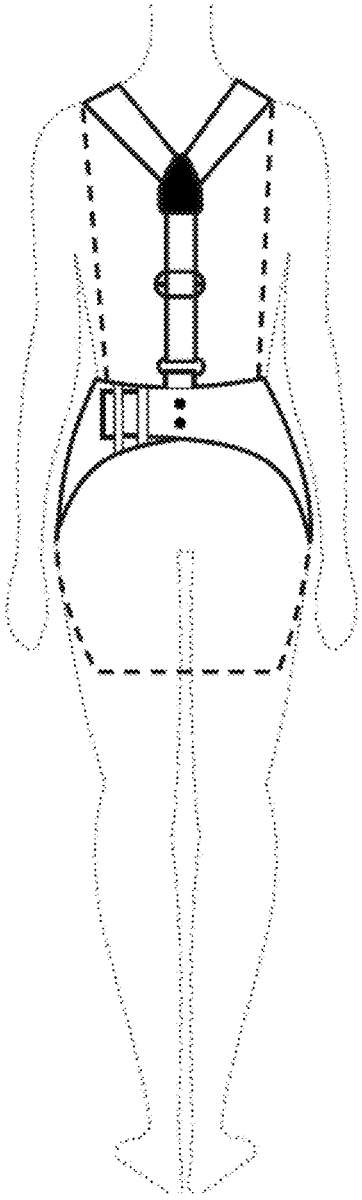
Figure 4C:
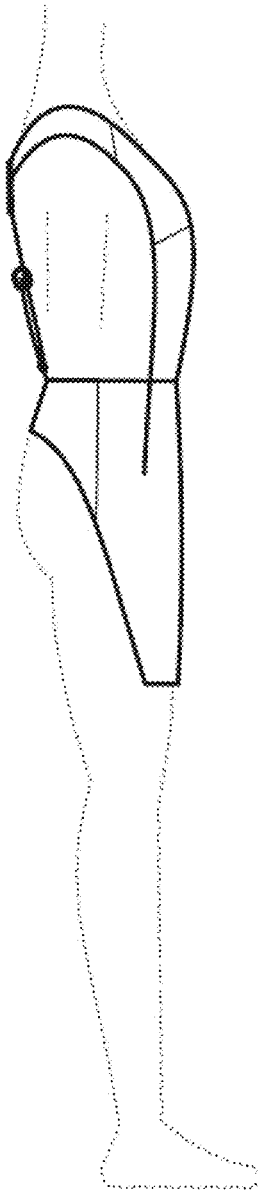

An exemplary protective garment having an adjustable closure system as substantially illustrated in FIG. 1A is provided in FIGS. 4A-4C. As shown, the protective garment comprises a bib with a seamed dart.

Example 3

Figure 5A:
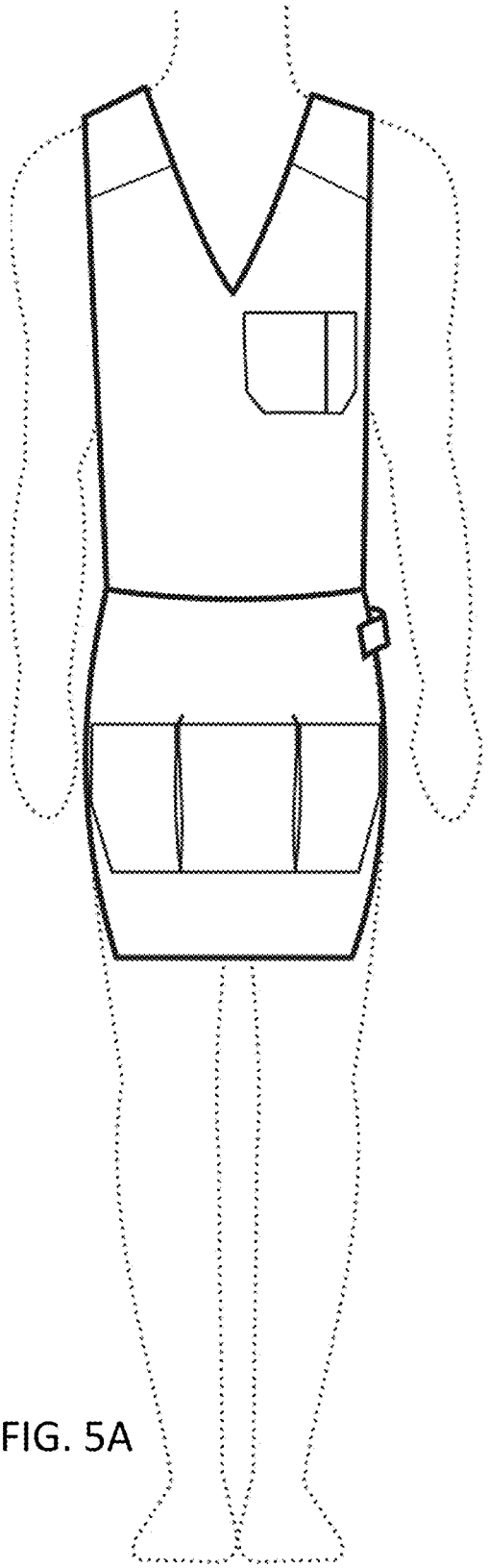
FIGS. 5A-5B illustrate an exemplary protective garment having a flat front.
Figure 5B:
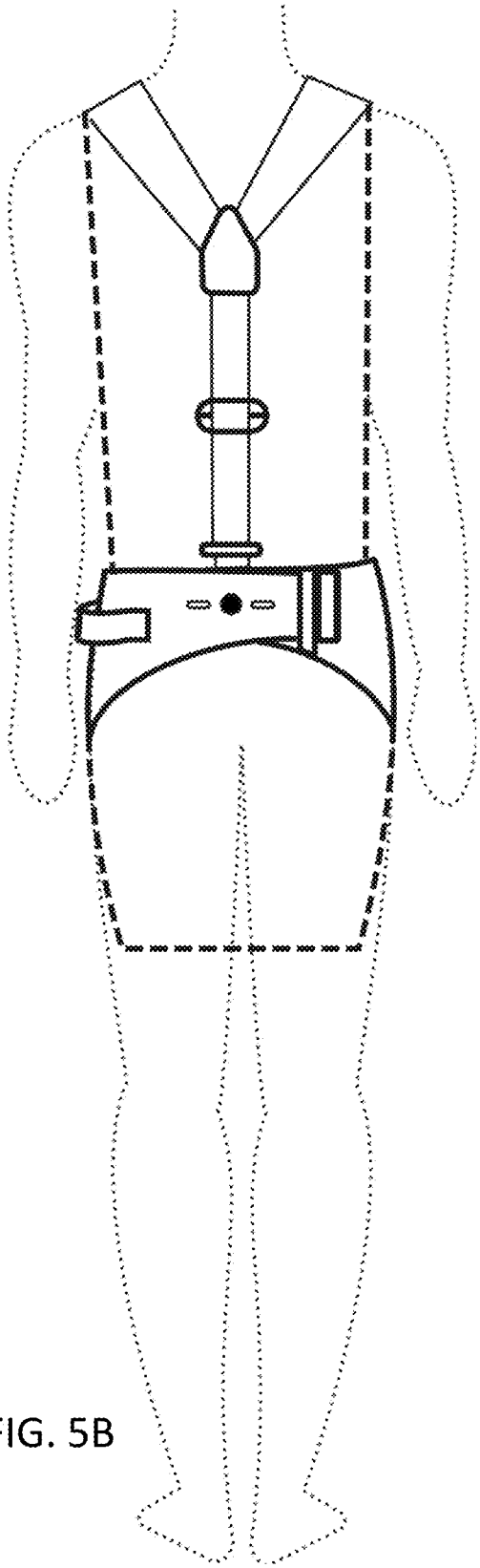

An exemplary protective garment having an adjustable closure system as substantially illustrated in FIG. 1B is provided in FIGS. 5A-5B. As shown, the protective garment comprises a bib with flat front. Example 3 also demonstrates the incorporation of pockets and loops in the bottom portion and bib of the garment.

Example 4

Figure 6A:
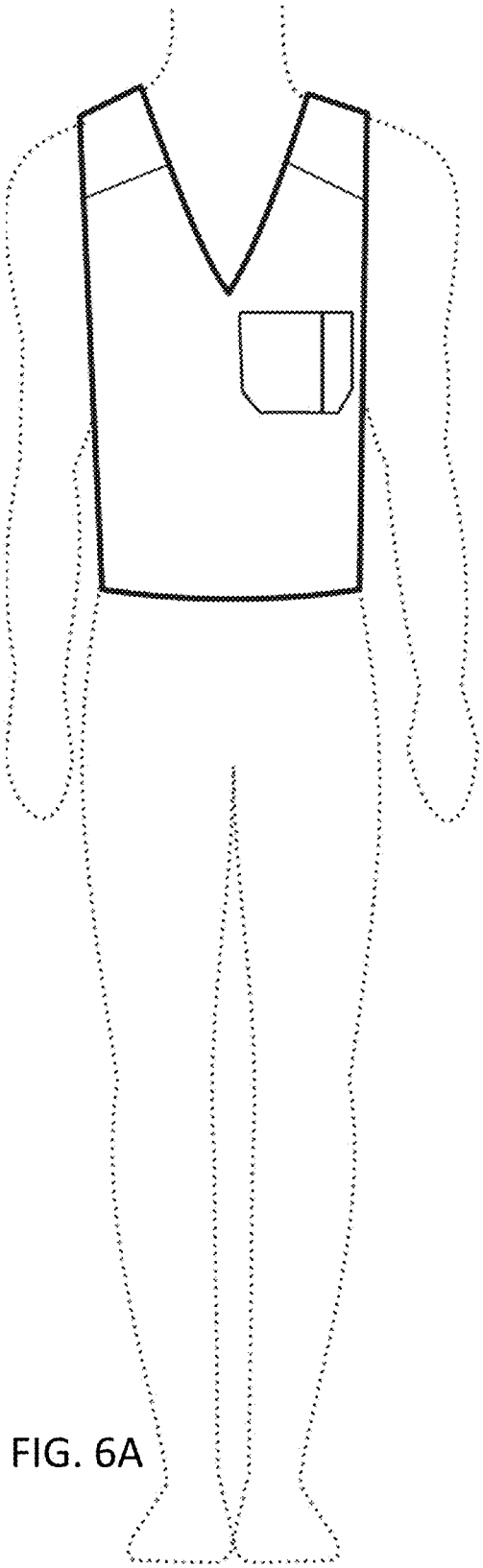
FIGS. 6A-6B illustrate an exemplary protective garment.
Figure 6B:
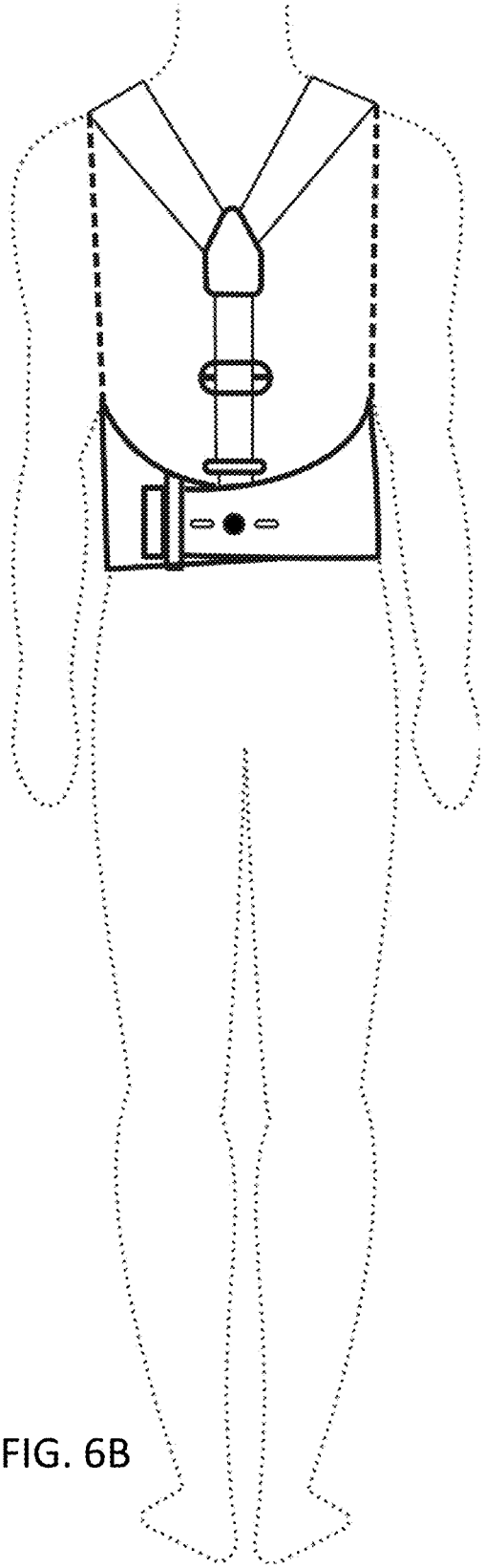

An exemplary protective garment having an adjustable closure system as substantially illustrated in FIG. 1B is provided in FIGS. 6A-6B. As shown, the protective garment comprises a bib with a flat front. Example 1 also demonstrates the incorporation of pockets and loops in the bib of the garment.

Example 5

Figure 7A:
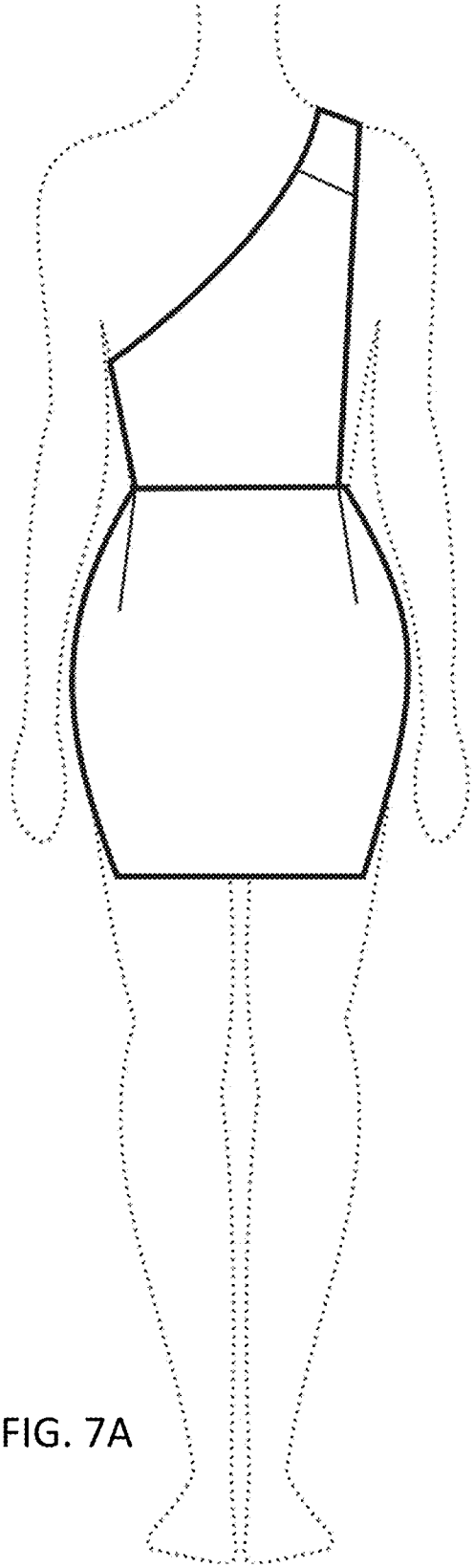
FIGS. 7A-7B illustrate an exemplary protective garment having a single shoulder strap.
Figure 7B:
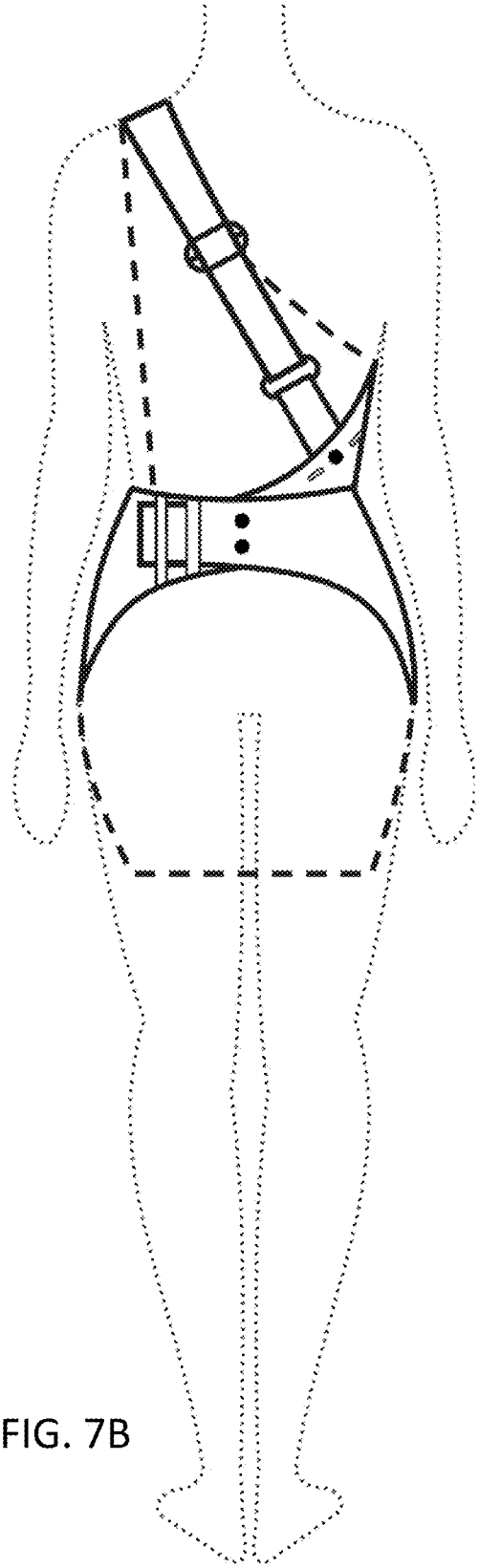

An exemplary protective garment having the adjustable shoulder strap extending from a single shoulder of the wearer and traversing the midline of the back of the wearer is illustrated in FIGS. 7A-7B.

What is claimed:

1. An adjustable closure system for use with a protective garment, the adjustable closure system comprising:

(a) a first flap, the first flap comprising a plurality of first fasteners, (b) a second flap, the second flap comprising a plurality of second fasteners, (c) an adjustable suspension strap, the adjustable suspension strap comprising a third fastener wherein the first flap is configured to extend inwardly from a first side of a wearer of the garment, wherein the second flap is configured to extend inwardly from a second side of the wearer and overlay the first flap when the first flap and second flap are secured, wherein the adjustable suspension strap is configured to be secured to the first flap, the second flap, or both the first flap and the second flap, and wherein the plurality of first fasteners comprises a male snap, a female snap, or a combinations thereof, the plurality of second fasteners comprises a male snap, a female snap, or a combinations thereof, and the third fastener comprises a male snap, female snap, or combination thereof or the plurality of first fasteners and the plurality of second fasteners are button holes and the third fastener is a button.

2. The adjustable closure system of claim 1, wherein the adjustable suspension strap comprises:

(i) a first strap portion, wherein the first strap portion is configured to extend downwardly from one or both shoulders of the wearer of the garment and wherein the first strap portion distal to the one or both shoulders of the wearer of the protective garment is doubled over itself and adjustably secured to itself;

(ii) a second strap portion, the second strap portion comprising the third fastener; and (iii) a connector joining the first strap portion and the second strap portion.

3. The adjustable closure system of claim 2, wherein the first strap portion is adjustably secured to itself with any one of a slide, buckle, reducer, strap adjuster, hook, loop, clasp, or fastener.

4. The adjustable closure system of claim 1, wherein the connector is a ring.

5. The adjustable closure system of claim 1, wherein the plurality of first fasteners, the plurality of second fasteners, or the third fastener comprises a member selected from the group consisting of a male snap, a female snap, a button, a button hole, a hook, an eye, a buckle, a tab, and any combination thereof.

6. The adjustable closure system of claim 1, wherein plurality of first fasteners are configured to be arranged in one or more substantially linear rows and wherein the plurality of second fasteners are configured to be arranged in one or more substantially linear rows.

7. The adjustable closure system of claim 1, wherein the first flap and the second flap are configured to be secured to each other by at least one of the plurality of first fasteners and at least one of the plurality of second fasteners.

8. The adjustable closure system of claim 1, wherein the first flap and the adjustable suspension strap are configured to be secured to each other by at least one of the plurality of first fasteners and the third fastener or wherein the second flap and the adjustable suspension strap are configured to be secured to each other by at least one of the plurality of second fasteners and the third fastener.

9. The adjustable closure system of claim 1, wherein the first flap and the adjustable suspension strap are configured to be secured to each other by at least one of the plurality of first fasteners and the third fastener and wherein the second flap and the adjustable suspension strap are configured to be secured to each other by at least one of the plurality of second fasteners and the third fastener.

10. An apron comprising an adjustable closure system and a bib, the adjustable closure system comprising:

(a) a first flap, the first flap comprising a plurality of first fasteners, (b) a second flap, the second flap comprising a plurality of second fasteners, (c) an adjustable suspension strap, the adjustable suspension strap comprising a third fastener wherein the first flap is configured to extend inwardly from a first side of a wearer of the garment, wherein the second flap is configured to extend inwardly from a second side of the wearer and overlays the first flap when the first flap and second flap are secured, and wherein the adjustable suspension strap is configured to be secured to the first flap, the second flap, or both the first flap and the second flap.

11. The apron of claim 10, wherein the bib comprises:

(a) a shoulder edge, (b) a bottom edge, and (c) an outside edge, wherein the shoulder edge comprises a curved portion extending inwardly from the outside edge and wherein the bottom edge comprises a curved portion extending inwardly from the outside edge.

12. The apron of claim 11, wherein the bib further comprises an inner edge that forms a neckline, wherein the shoulder edge comprises a linear portion interposed between the curved portion and the inner edge.

13. The apron of claim 11, wherein the shoulder edge is configured to be joined to a linear portion of a shoulder strap.

14. The apron of claim 11, wherein the bib further comprises a second outside edge, wherein the bottom edge comprises a second curved portion extending inwardly from the second outside edge and a linear portion interposed between the curved portion and the second curved portion.

15. The apron of claim 11, wherein the bottom edge is configured to be joined to a linear portion of a bottom front.

16. The apron of claim 11, wherein the curved portion of the shoulder edge extends over a length between about 1 inch to about 3 inches with a depth between ⅛ of an inch to ½ of an inch.

17. The apron of claim 11, wherein the curved portion of the bottom edge extends over a length between about 1 inch to about 3 inches with a depth between ⅛ of an inch to ½ of an inch.

18. The apron of claim 10, wherein the adjustable suspension strap comprises:

(i) a first strap portion, wherein the first strap portion is configured to extend downwardly from one or both shoulders of the wearer of the garment and wherein the first strap portion distal to the one or both shoulders of the wearer of the protective garment is doubled over itself and adjustably secured to itself;

(ii) a second strap portion, the second strap portion comprising the third fastener; and (iii) a connector joining the first strap portion and the second strap portion.

19. The apron of claim 10, wherein the plurality of first fasteners comprises a male snap, a female snap, or a combinations thereof, the plurality of second fasteners comprises a male snap, a female snap, or a combinations thereof, and the third fastener comprises a male snap, female snap, or combination thereof.

20. The apron of claim 10, wherein the plurality of first fasteners and the plurality of second fasteners are button holes and the third fastener is a button.

* * * * *